United States Patent [19]

Giannatto et al.

[11] 3,982,250

[45] Sept. 21, 1976

[54] RETRACTABLE RADOME

[75] Inventors: Carl J. Giannatto, Satellite Beach, Fla.; Theodore Watkin, Stamford, Conn.

[73] Assignee: United Technologies Corporation, Hartford, Conn.

[22] Filed: Oct. 15, 1975

[21] Appl. No.: 622,791

[52] U.S. Cl. ..... 343/872
[51] Int. Cl.[2] ..... H01Q 1/42
[58] Field of Search ..... 343/872, 871

*Primary Examiner*—Harold A. Dixon
*Attorney, Agent, or Firm*—Dominic J. Chiantera

[57] ABSTRACT

A retractable radome assembly is comprised of a number of hollow casings having successively smaller transverse dimensions, disposed to permit nesting of a smaller dimension casing within a next adjacent larger dimension casing in a vacuum sealing relationship and in such a manner as to permit relative mobility of adjacent casings in a coaxial telescoping manner from a fully retracted to a fully extended coaxial position. The casing sections are maintained in the fully extended position through forces created by a differential pressure between the outside atmosphere and a vacuum atmosphere provided within the casing wall structure, the radome being maintained in the fully retracted position through the use of mechanical retracting assembly applied in the absence of a vacuum atmosphere within the wall structure.

2 Claims, 5 Drawing Figures

RETRACTABLE RADOME

BACKGROUND OF THE INVENTION

1. Field of Invention

This invention relates to a radome for use on board an aircraft, and more particularly to a retractable radome for use with a retractable radar antenna.

2. Description of the Prior Art

The use of radar searching equipment on board aircraft requires rotatable antenna assemblies for scanning through 360° of azimuth, or through some smaller sector therewithin. In order to prevent interference with the radar transmission by the body of the aircraft, it is necessary to extend the antenna some distance from the aircraft body while the scanning operation is performed. However, the aerodynamic turbulence created by an antenna structure projected from the aircraft body is substantial even for relatively slow flying aircraft, such as a helicopter. The aerodynamic effect upon the aircraft caused by the antenna structure is such as to produce a drag effect which varies with the size of the antenna reflector and the change in position of the antenna as it scans through the sector. The change in drag caused by the antenna rotation further produces a cyclic, aerodynamically induced torque about the antenna axis, which induces substantial, cyclic, pitch and roll moments about the aircraft as the antenna rotates, affecting aircraft stability and handling in forward flights at cruise and at high speeds. Furthermore, the cyclic parasite drag variations and attendant power compensation variations required to maintain a given forward flight speed may also be unacceptable.

The effect of the aerodynamic loading upon the antenna structure itself, produces severe force moments upon the antenna as it rotates through the sector. This force moment results in bearing assembly wear, and also requires that the antenna drive motor torque be programmed to accommodate the cyclic torque variations.

In view of the undesirable effects on both aircraft and antenna, it is necessary to enclose the antenna structure within some type of radome. The radome structure prevents the aerodynamic loading upon the antenna structure itself, and virtually eliminates the cyclic force moments on the aircraft due to the antenna rotation, however, the radome structure still presents a significant drag factor to the aircraft during forward flight. While such a drag effect is unavoidable during the operation of the radar system, it is desirable to further minimize the drag effect for periods of nonoperation. This may be accomplished in a radar system employing a retractable antenna structure, wherein it is permissible to use a retractable radome structure, which during periods of nonoperation may be retracted to provide a much smaller profile on the aircraft surface.

SUMMARY OF THE INVENTION

An object of the present invention is to provide a retractable radome assembly having a structure which is fabricated from a lightweight, dielectric material, making it suitable for use in airborne radar systems using a retractable radar antenna assembly. Another object of the present invention is to provide a retractable radome which presents a rigid structure and a high degree of holding force in the fully extended position to withstand the aerodynamic shear forces generated by an aircraft in forward flight.

According to the present invention, a retractable radome assembly includes at least two casing means, each having a cavity extending therethrough along a common longitudinal axis, the casings being of successively smaller dimensions for nesting of a smaller dimension casing within a next adjacent larger dimension casing to permit relative mobility of adjacent casings in a coaxial telescoping manner from a fully retracted to a fully extended coaxial position, each casing having an inner wall surface and an outer wall surface, with the outer wall surface of a smaller dimension casing and the inner wall surface of the next adjacent larger dimension casing being relatively disposed in a vacuum sealing relationship for providing a vacuum chamber therebetween, the inner and outer wall surfaces of each casing defining a central area therebetween, and the central area having a plurality of vacuum conduits disposed therethrough for providing a continuous vacuum path between successive vacuum chambers. In further accord with the present invention, a vacuum pump is connected to one end of the series of vacuum conduits for selectively providing a vacuum atmosphere within the conduits of successive casings to provide a differential pressure between the vacuum chambers and the outside atmosphere, creating a force for extending the assembly and for maintaining a rigid extended structure. In still further accord with the present invention, a mechanical drive assembly, including a motor, unidirectional clutch, cable assembly is connected to the smallest dimension casing through a plurality of cables, for selectively retracting all of the casings in the absence of a vacuum atmosphere in the vacuum conduits.

In further accord with the present invention, the inner and outer wall surfaces of each casing and the central area defined therebetween, the vacuum conduits, and the cables are fabricated from a dielectric material to minimize interference with the transmitted radar beam pattern.

The retractable radome of the present invention provides a protective covering of an airborne radar antenna, and in addition substantially reduces the cyclic torque effects on an aircraft due to the cyclic or scanning operation of the radar antenna assembly. In addition, during periods of nonuse with the antenna retracted, the radome assembly is likewise retracted, therefore, providing a low aircraft surface profile which substantially reduces aerodynamic drag forces. The lightweight structure of the radome assembly provides a minimum of added aircraft weight, while the dielectric material used in the structure provides a minimum of interference with the transmission of the radar beam pattern. In the fully extended mode, rigidity of the radome structure is assured through the use of a vacuum atmosphere within the wall structure of the radome, resulting in a high degree of holding force derived from the pressure differential between the inside vacuum and outside atmospheric pressure. In the fully retracted mode, with the vacuum atmosphere removed from within the wall structure, a rigid retracted radome is provided through the use of a mechanical retracting and holding apparatus. Through suitable phasing of the application of a vacuum atmosphere and simultaneous release of the retracting force, a smooth "anticocking" extension and retraction process is achieved.

The foregoing and other objects, features and advantages of the present invention will become more apparent in the light of the following detailed description of the preferred embodiment thereof, as illustrated in the accompanying drawing.

DESCRIPTION OF THE PREFERRED EMBODIMENT

The retractable radome assembly of the present invention, which presents a minimum of additional weight to the aircraft, provides a rigid, extended structure for the protection of a retractable radar antenna (not shown) under aerodynamic loading conditions presented in forward flight, and provides smooth anticocking operation for both extension and retraction of the radome assembly.

Figure 1:
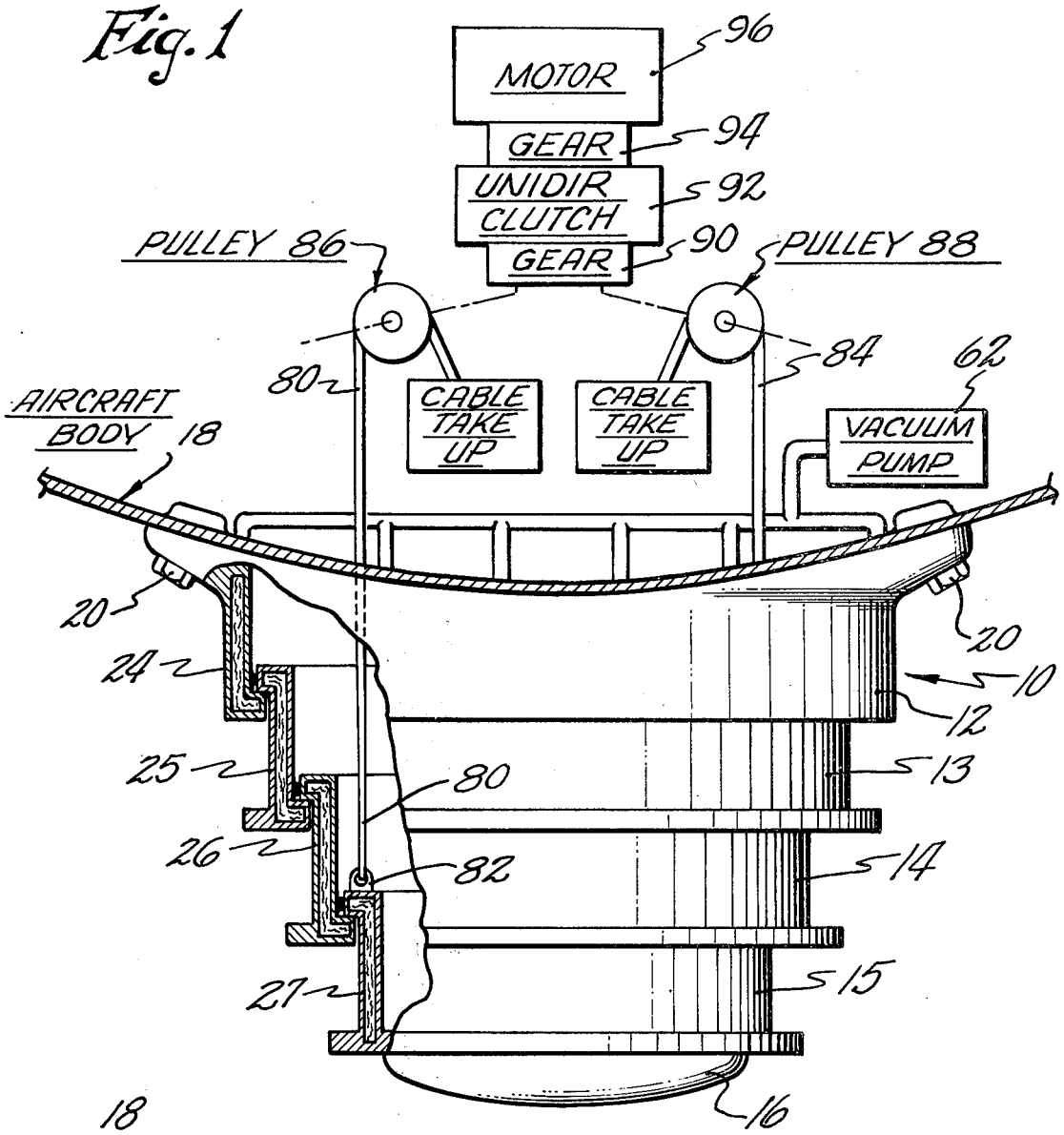
FIG. 1 is an illustration of an exemplary embodiment of a retractable radome according to the present invention.

Referring now to FIG. 1, in an exemplary embodiment of a retractable radome according to the present invention, a radome assembly 10 is comprised of four coaxial sections 12–15 having hollow central portions along a common longitudinal axis, and having successively smaller transverse dimensions, such that sections 13–15 are movable along the common axis in a telescoping manner from a fully retracted position, wherein sections 13–15 are retracted within the structure 12, to a fully extended position shown in FIG. 1. The section 15 is integral with a cover section 16, and the section 12 is mounted to a portion of the aircraft body 18 through a suitable mounting means 20, such as bolts or the like. In the embodiment of FIG. 1, sections 12–15 are cylindrically shaped, although the sections may be of any geometric shape, such as elliptical or rectangular, with consideration given to aircraft aerodynamic loading effects and the geometry of the enclosed antenna structure.

Figure 2:
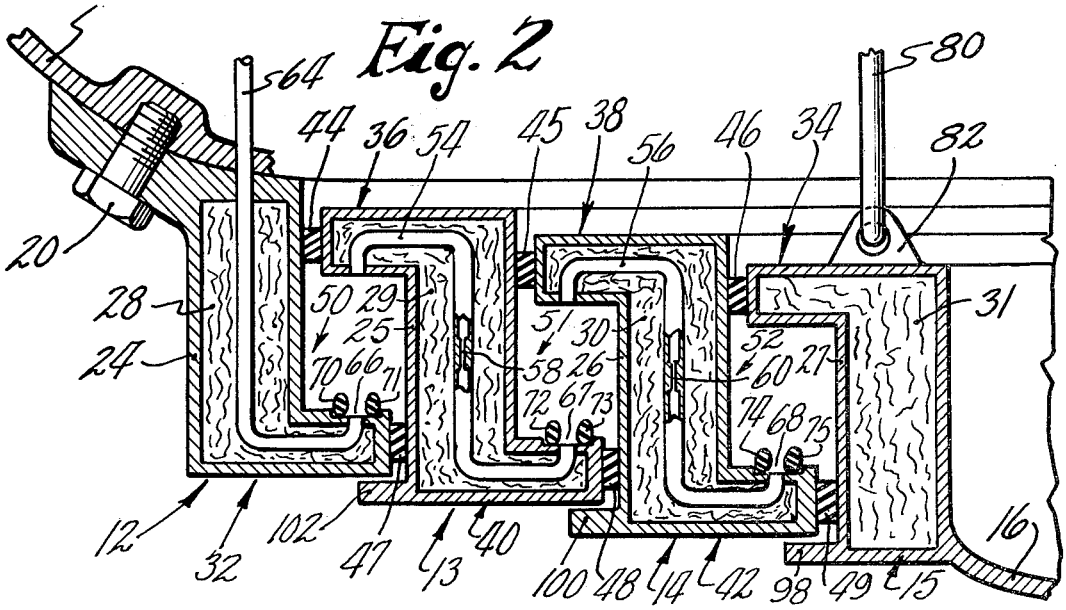
FIG. 2 is an illustration of a cutaway portion of the radome assembly of FIG. 1.

The wall construction of the sections is shown in FIG. 2, which is a detailed illustration of the cutaway left hand portion of the assembly 10, wherein the sections 12–15 have walls 24–27 having solid inner and outer surfaces fabricated from a lightweight, dielectric material, such as fiber glass or the like, to provide a minimum of added aircraft weight and minimum interference with the radar beam pattern transmission. The walls 24–27 have central areas 28–31, defined by the inner and outer surfaces, which are fabricated from a similar, lightweight, dielectric material, such as honeycombed fiber glass or the like, having dielectric and lightweight properties similar to those of the wall surfaces. The section 12 has a single, lower cantilevered portion 32, while the section 15 has a single upper cantilevered portion 34. The sections 13–14 are identical, and have upper cantilevered portions 36, 38 and lower cantilevered portions 40, 42 respectively. The solid inner and outer surfaces of the walls 24–27, of the sections 12–15 are mated in a vacuum sealing relationship provided by pressure type seals 44–49 such as O-ring seals or the like. Therefore, the space between the outer wall surface of a smaller casing and the inner wall surface of a next adjacent larger casing form a vacuum chamber, such as vacuum chambers 50–52, when the sections 12–15 are in the retracted position. The chambers 50–52 have a variable volume, which is dependent upon the relative position of the respective sections forming the chambers, and are reduced to a substantially zero volume when the sections are in the fully extended position as shown in FIG. 1.

Figure 3:
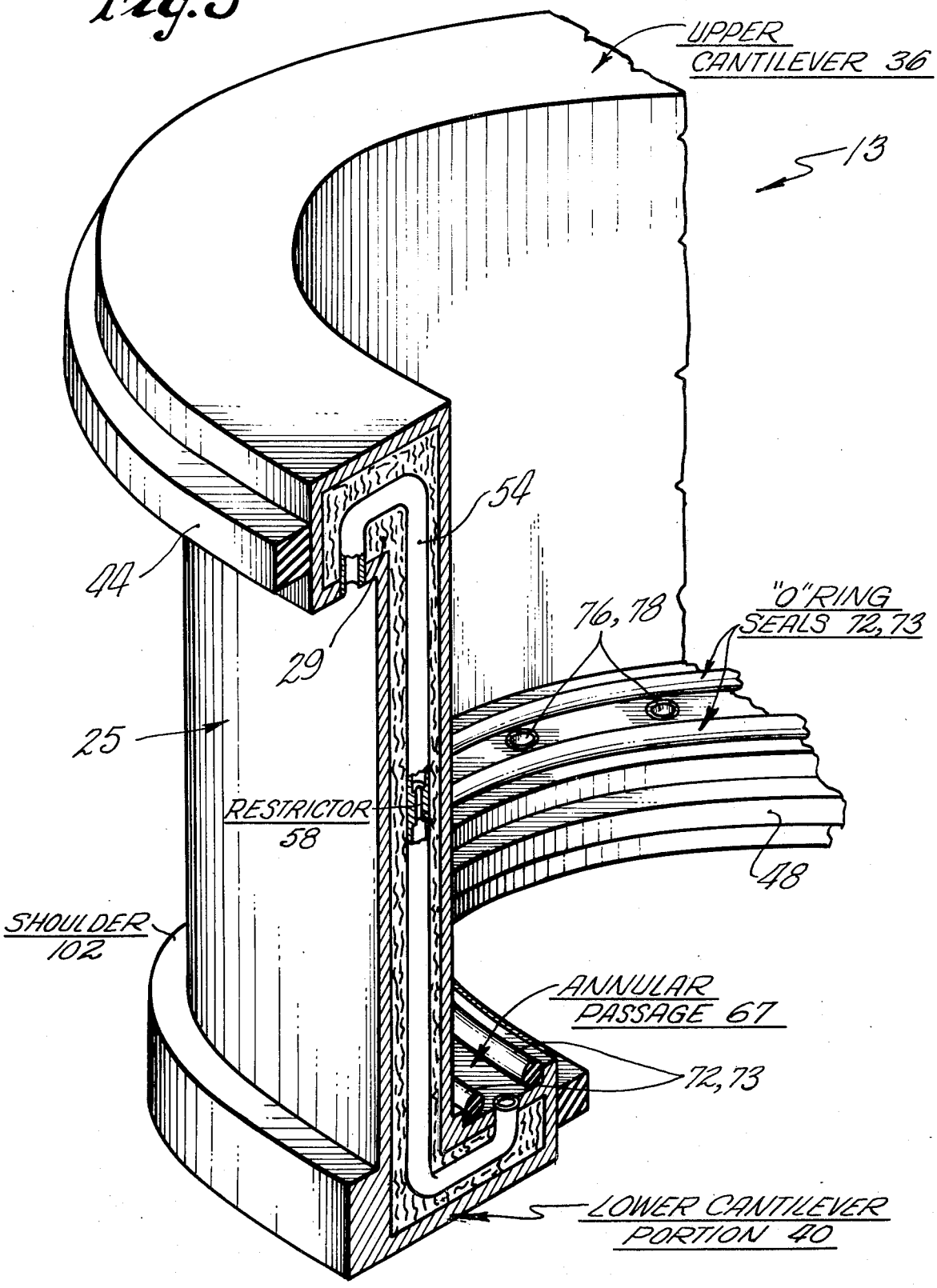
FIG. 3 is a partial perspective drawing of a portion of one section of the retractable radome shown in the embodiment of FIG. 1.

The chambers 50–52 are interconnected through vacuum conduit means such as vacuum pipes 54, 56 disposed within the wall central areas 29, 30 of sections 13, 14. These pipes are fabricated from material having similar dielectric properties to that of the wall surfaces and central areas, and in addition exhibit structural characteristics sufficient to withstand pressure differentials of typically one-half sea level atmosphere between the internal and external portions of the tubes. The pipes 54, 56 contain flow restrictors 58, 60 which restrict vacuum flow through the tubes, as described hereinafter. The chamber 50 is connected to a vacuum pump 62, shown in FIG. 1, through a pipe 64 identical to the pipes 54, 56. The pipes 64, 54, 56 are connected to the chambers 50–52 through annular air passages 66–68 which run around the circumference of the respective cantilevered portions 32, 40, 42, and which include O-ring seals 70–75. A partial perspective drawing illustrating the prominent features of the section 13 which are essentially common to the sections 12–14, is shown in FIG. 3, wherein the features described hereinbefore are shown in addition to the openings 76, 78 of additional pipes similar to that of the pipe 54, which are connected to the annular passage 67.

Referring again to FIG. 1, the section 15 is connected at a point on the upper surface of the cantilevered portion 34 to a cable 80 through a mechanical mounting means 82, shown in the cutaway of the left hand portion of the housing 10, and is similarly connected to a cable 84 through a similar mounting means not shown. Although only two cables 80, 84 are shown, additional cables may be required as determined by design choice or the dimensions of the radome sections. The cables 80, 84 are fabricated from dielectric material similar to that described hereinbefore with respect to the walls and vacuum conduits to minimize interference with the radar transmission. The cables 80, 84 are connected through pulley assemblies 86, 88 which are suitably connected through a gear assembly 90, a unidirectional clutch assembly 92, and a second gear assembly 94 to a driving motor assembly 96. If, as stated hereinbefore, additional cables are required, an equal number of additional pulley assemblies will be required. The driver motor 96 and gear assembly 94 are used to retract the cables 80, 84, in addition to positioning a retractable radar antenna structure, not shown.

In the fully retracted position shown in FIG. 2, the sections 13–15 are maintained in the retracted mode by tension applied through the cable 80 (and 84 not shown in FIG. 2) to the section 15, which through a shoulder portion 98 which overlaps with the cantilevered portion 42 of section 14, bears on this cantilevered portion to cause the section 14 to be held in the retracted mode. Similarly, like shoulder portions 100, 102 of sections 14, 13, and the like cantilevered portions 40, 32 of sections 13, 12, cause the tension of the cable 80 to be successively transmitted through sections 15, 14 and 13 to the rigid section 12 which is mounted to the aircraft body 18. Therefore, with tension applied to the cables 80, 84 the sections 13–15 are retracted in a "telescoping" manner and are held in the retracted position through the constant application of tension through the cables.

Figure 4:
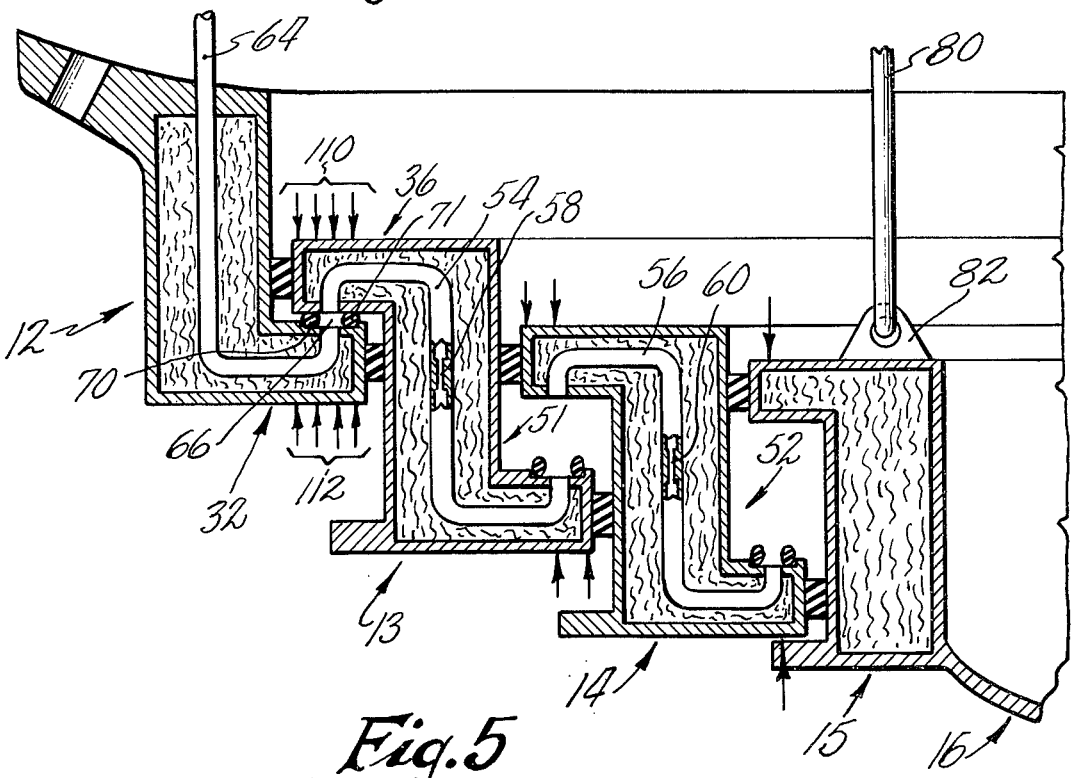
FIG. 4 is an illustration of the operation of the portion of the radome shown in FIG. 2.
Figure 5:
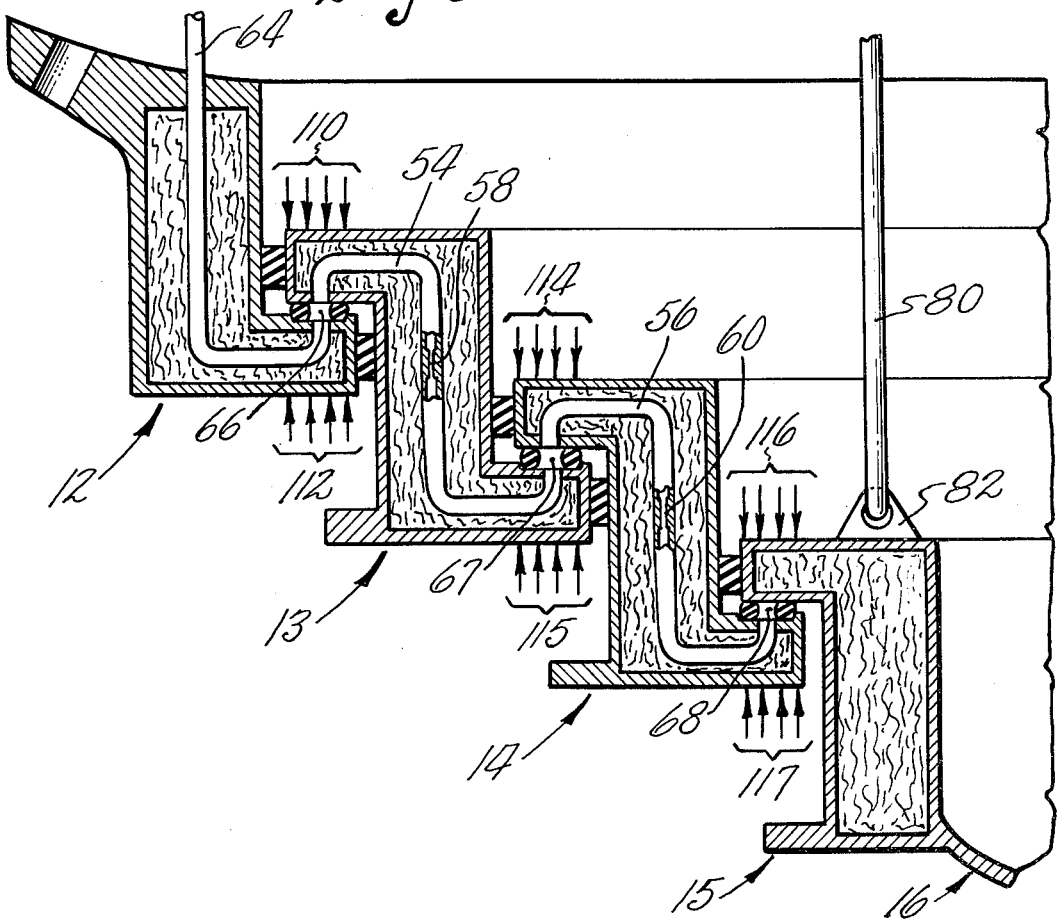
FIG. 5 is another illustration of the operation of the portion of the radome shown in FIG. 2.

In extending the radome assembly 10 from the fully retracted position shown in FIG. 2, the vacuum pump 62 (FIG. 1) causes a vacuum to be provided through the pipe 64 of section 12 into the chamber 50, and successively through the pipes 54, the chamber 51, the pipe 56, and the chamber 52. Due to the orificing effect of the flow restrictors 58, 60, the vacuum flow is metered to the chambers 51, 52 causing the vacuum to be greatest in the chamber 50. The creation of a vacuum atmosphere within the chamber 50 causes a net force to be generated on the cantilevered portions 32, 36 of sections 12, 13, as shown in FIG. 4 by the force vectors 110, 112, due to atmospheric pressure outside of the chamber. As the vacuum, and the subsequent force due to atmospheric pressure builds up, a slackening of the tension of the cables 80, 84 on section 15, as provided by the motor 96 through the clutch assembly 92, causes the section 13 to slowly extend. Since the vacuum flow is metered to chambers 51, 52 the force on the cantilevered portions 38, 40 of sections 14, 13 and the cantilevered portions 46, 42 on sections 15 and 14 is less than that on the cantilevered portions 36, 32 of sections 13, 12, the sections 14, 15 follow the section 13 as a unit. Once the cantilevered portion 36 of section 13 makes contact with the portion 32 of section 12 (as shown in FIG. 4) its downward motion is impeded, while the annular passage 66 and O-ring seals 70, 71 create a hermetic vacuum path to the pipe 54 causing an increase in vacuum flow through the pipe 54. The vacuum flow is now increased in the chamber 51 at a greater rate than that in the chamber 52 due to the orificing effect of the restrictor 60 resulting in an extension of the sections 14, 15 as a unit. Contact of the cantilevered portion 38 of section 14 with the cantilevered portion of section 13 impedes the downward motion of the section 14 while the hermetic vacuum path through the annular passage 67 and the O-ring 72, 73 accelerate the vacuum flow through the tube 56 to the chamber 52 causing the section 15 to similarly fully extend. When the extension of sections 13–15 is completed the vacuum through the tubes 64, 54, 56 is maintained causing the force due to atmospheric pressure on the surfaces of the sections to maintain the extended radome in a rigid manner as shown in FIG. 5 by the force vectors 114–117.

By extending the radome sections in successive stages with the vacuum force acting against some residual tension applied by the cables 80, 84, maximum control over the extension process is achieved and "cocking tendencies" of the sections (binding of portions of the sections due to uneven rates of extension) are minimized. Once the radome housing is in the extended position, it is held erect by the forces acting between the mating cantilevered portions of the four sections. The force created by the net pressure differential induced by the vacuum, acting on the large area of the annular rings, is more than sufficient to withstand the separation forces created by the drag on the radome at aircraft speeds of over 150 knots $$(277.8 \frac{\text{kilometers}}{\text{hour}}).$$

The radome housing is retracted by first decreasing the vacuum provided by the pump 62 in the annular passage 66 of section 12. The flow restrictors are now effective in the reverse direction by metering the decreasing vacuum in subsequent sections. The annular passage 66 will then have less holding force than the remaining annular passages such that a retraction of the cables 80, 84 causes the sections 13–15 to retract as a unit until the shoulder 102 of section 13 makes contact with the cantilevered portion 32 of section 12 which impedes further upward motion of the section 13, at which time the increased volume of the chamber 50 causes the further increase in vacuum reduction in the annular passage 67 of section 13 causing a retraction of the sections 14, 15 as a unit, due to the metering of the reduced vacuum by the restrictor 60. When the section 14 is fully retracted and its motion is impeded by contact between shoulder 100 and the cantilevered portion 40 of section 13, the section 15 is retracted alone. The retraction process through the use of increased tension applied through the retraction of the cables 80, 84 overcoming the opposing forces due to the residual vacuum and slow reduction thereof provides the same anticocking and controlled retraction rate exhibited in the extension process.

The retractable radome of the present invention, as stated hereinbefore, may include sections other than that of a cylindrical shape. Similarly, the number of sections required may be less or greater than that shown in the embodiment of FIG. 1 and will be dependent upon the size of the enclosed radar antenna in the extended position, and the requirement for the smallest surface profile in the fully retracted position. The number of vacuum conduits required in each of the sections, the volume of the vacuum pump, and the size of the retracting motor drive assembly are all dependent upon the overall size and weight provided by any given configuration. Similarly, although the invention has been shown and described with respect to preferred embodiments thereof, it should be understood by those skilled in the art that the foregoing and various changes, omissions and additions may be employed without departing from the spirit and the scope of the invention.

Having thus described a typical embodiment of our invention, that which we claim as new and desire to secure by Letters Patent is:

1. A retractable radome, comprising:

at least two casing means, each having a cavity extending therethrough along a common longitudinal axis, said casing means being of successively smaller dimensions for nesting of a smaller dimension casing within a next adjacent larger dimension casing to permit relative mobility of adjacent casings in a coaxial telescoping manner from a fully retracted to a fully extended coaxial position, each of said casing means including inner wall surface means and outer wall surface means, the outer wall surface means of a smaller dimension casing and the inner wall surface means of a next adjacent larger dimension casing being relatively disposed in a vacuum sealing relationship for providing a vacuum chamber therebetween, said inner and outer wall surface means of each casing defining a central area therebetween, said central area having a plurality of vacuum conduit means disposed therethrough for providing a continuous vacuum path between successive vacuum chambers;

vacuum means connected to said conduit means for selectively providing a vacuum atmosphere within said conduit means; and means connected to the smallest casing for retracting all of said casings in the absence of a vacuum atmosphere in said conduit means.

2. A retractable radome according to claim 1, wherein said inner and outer wall surface means of each casing and the central area therebetween, and said vacuum conduit means, are comprised of a dielectric material.

* * * * *